US008512477B2

(12) United States Patent
Beer et al.

(10) Patent No.: US 8,512,477 B2
(45) Date of Patent: Aug. 20, 2013

(54) DISHWASHER AND METHOD FOR OPERATING A DISHWASHER

(75) Inventors: Hans Beer, Medlingen (DE); Roland Rieger, Rainau/Schwabsberg (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 542 days.

(21) Appl. No.: 10/873,403

(22) Filed: Jun. 21, 2004

(65) Prior Publication Data

US 2004/0238015 A1 Dec. 2, 2004

Related U.S. Application Data

(63) Continuation of application No. PCT/EP02/12949, filed on Nov. 19, 2002.

(30) Foreign Application Priority Data

Dec. 21, 2001 (DE) ..... 101 63 196

(51) Int. Cl.
*A47L 15/23* (2006.01)

(52) U.S. Cl.
USPC ..... 134/18; 134/25.2; 134/57 D; 134/179; 134/200

(58) Field of Classification Search
USPC ..... 134/18, 25.2, 56 D, 57 D, 58 D, 134/200, 201; 68/18, 25.2, 56 D, 57 D, 58 D, 68/172, 176, 178, 179, 198, 200, 201
See application file for complete search history.

(56) References Cited

U.S. PATENT DOCUMENTS

| | | | | |
|---|---|---|---|---|
| 3,986,023 | A | 10/1976 | Früngel | |
| 4,673,441 | A * | 6/1987 | Mayers | 134/18 |
| 4,741,353 | A * | 5/1988 | Milocco | 137/119.03 |
| 5,264,043 | A * | 11/1993 | Milocco | 134/25.2 |
| 5,331,986 | A * | 7/1994 | Lim et al. | 134/88 |
| 5,494,062 | A | 2/1996 | Springer | |
| 5,849,101 | A * | 12/1998 | Edwards et al. | 134/18 |
| 6,601,593 | B2 | 8/2003 | Deiss et al. | |
| 2002/0007843 | A1 * | 1/2002 | Deiss et al. | 134/25.2 |

(Continued)

FOREIGN PATENT DOCUMENTS

| | | |
|---|---|---|
| DE | 24 28 901 A1 | 1/1976 |
| DE | 195 40 871 A1 | 5/1997 |

(Continued)

OTHER PUBLICATIONS

Electronic English translation of WO 00/33720.*

*Primary Examiner* — Joseph L Perrin
(74) *Attorney, Agent, or Firm* — James E. Howard; Andre Pallapies

(57) ABSTRACT

A dishwasher and a method for operating a dishwasher reduce the length of a washing cycle in a dishwasher as well as the noise which is generated by the impact of the water therein, without altering the performance of the dishwasher. The washing method for a dishwasher having at least two spray devices includes dividing a significant period of time of a washing program duration into a plurality of different lengths of sub-units of time. Substantially every sub-unit of time is made up of at least two time sections. During a first time section, the washing liquid passes through all of the spray devices and during a second time section, the liquid only passes through the lowermost or the uppermost spray device. A dishwasher having at least two spray devices carries out the washing method.

13 Claims, 3 Drawing Sheets

(56) References Cited

U.S. PATENT DOCUMENTS

2002/0183726 A1 12/2002 Elbrecht et al.

FOREIGN PATENT DOCUMENTS

| | | | |
|---|---|---|---|
| DE | 198 12 231 | A1 | 9/1999 |
| DE | 198 23 806 | A1 | 12/1999 |
| DE | 199 59 698 | A1 | 6/2001 |
| EP | 0 483 466 | A1 | 5/1992 |
| EP | 0 547 011 | A1 | 6/1993 |
| EP | 0 793 939 | A1 | 9/1997 |
| WO | 00/33720 | | 6/2000 |

* cited by examiner

DISHWASHER AND METHOD FOR OPERATING A DISHWASHER

CROSS-REFERENCE TO RELATED APPLICATION

This application is a continuation, under 35 U.S.C. §120, of copending International Application No. PCT/EP02/12949, filed Nov. 19, 2002, which designated the United States; this application also claims the priority, under 35 U.S.C. §119, of German Patent Application 101 63 196.0, filed Dec. 21, 2001; the prior applications are herewith incorporated by reference in their entirety.

BACKGROUND OF THE INVENTION

Field of the Invention

The invention relates to a method for operating a dishwasher with at least two spray devices. The invention also relates to a dishwasher with at least two spray devices, in which the dishwashing method is used.

Dishwashers with alternating spray-level operation have been known for some time, for example from German Published, Non-Prosecuted Patent Application 198 12 231 A1. In the case of commercially available domestic dishwashers, the spray devices are charged simultaneously with liquid fed by a circulating pump. On one hand, such so-called two-rack or multi-rack washing has the advantage that the force to which the items which are to be washed are subjected by the water jet is relatively high, and food residues are thus detached relatively quickly. However, on the other hand, high water and energy consumption and the associated high level of noise development has proven to be disadvantageous in the two-rack or multi-rack washing operation. In addition to the two-rack or multi-rack washing operation, also known is so-called alternate-rack washing operation, in which respective spray levels are activated specifically with alternate operation. Although the low water and energy consumption and the associated low level of noise development are advantageous, the low level of mechanical action of the water jet as a result of the items which are to be washed being subjected merely to alternating spraying is disadvantageous and result in the dishwashing-program duration being prolonged.

SUMMARY OF THE INVENTION

It is accordingly an object of the invention to provide a dishwasher and a method for operating a dishwasher, which overcome the hereinafore-mentioned disadvantages of the heretofore-known devices and methods of this general type and which reduce both dishwashing-program duration of a dishwasher and the level of noise development caused by the impact of water, while maintaining dishwashing performance.

With the foregoing and other objects in view there is provided, in accordance with the invention, a method for operating a dishwasher. The method comprises providing at least two spray devices including a lowermost spray device and an uppermost spray device. A significant time period of a dishwashing-program duration is divided into a multiplicity of sub-units of time of different lengths. Substantially each of the sub-units of time includes at least first and second time sections. A flow of dishwashing liquid is passed through all of the spray devices during the first time section. A flow of dishwashing liquid is passed through only the lowermost spray device or the uppermost spray device during the second time section.

With the objects of the invention in view, there is also provided a dishwasher, comprising at least two spray devices, and a program-control subassembly associated with the at least two spray devices for carrying out the method for operating the dishwasher.

In accordance with another mode of the invention, a sub-unit of time contains two time sections in which the action of the uppermost spray device and the lowermost spray device alternates.

It is advantageous for the first time section to immediately precede the second time section. The length of the respective time sections may be determined in accordance with the respective dishwashing-program selection. It is expediently the case, with the selection of a dishwashing program in which particularly heavily soiled items are disposed in the bottom dish rack, that the second time section, in which merely the lowermost spray device has dishwashing liquid flowing through it, is longer than in the case of a dishwashing program in which the items located in the top rack are only slightly less soiled than the items located in the bottom rack. As a result, in accordance with a further mode of the invention, the first and second time sections in this case are of substantially equal length.

In accordance with a concomitant mode of the invention, all of the time sections have different lengths.

When use is made of the dishwashing method according to the invention, in the second time section, during which merely the lowermost or uppermost spray device has dishwashing liquid flowing through it, the items located in the lowermost or uppermost dish rack are subjected to a higher mechanical water force. As a result, the cleaning performance for the items located in the bottom or top dish rack is significantly increased. By virtue of the circulating periods being reduced due to the higher level of mechanical action exerted by the dishwashing liquid, the dishwashing-program duration is reduced and, by virtue of the at least temporary single-rack washing operation, in which case merely the bottom spray device is activated, the level of noise development is advantageously reduced.

The method for operating a dishwasher according to the invention and the dishwasher according to the invention having at least two spray devices and carrying out the method for operating a dishwasher according to the invention, have thus succeeded in the task of reducing both the dishwashing-program duration of the dishwasher and the level of noise development which is caused by the impact of the water, while maintaining the dishwashing performance.

Other features which are considered as characteristic for the invention are set forth in the appended claims.

Although the invention is illustrated and described herein as embodied in a dishwasher and a method for operating a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
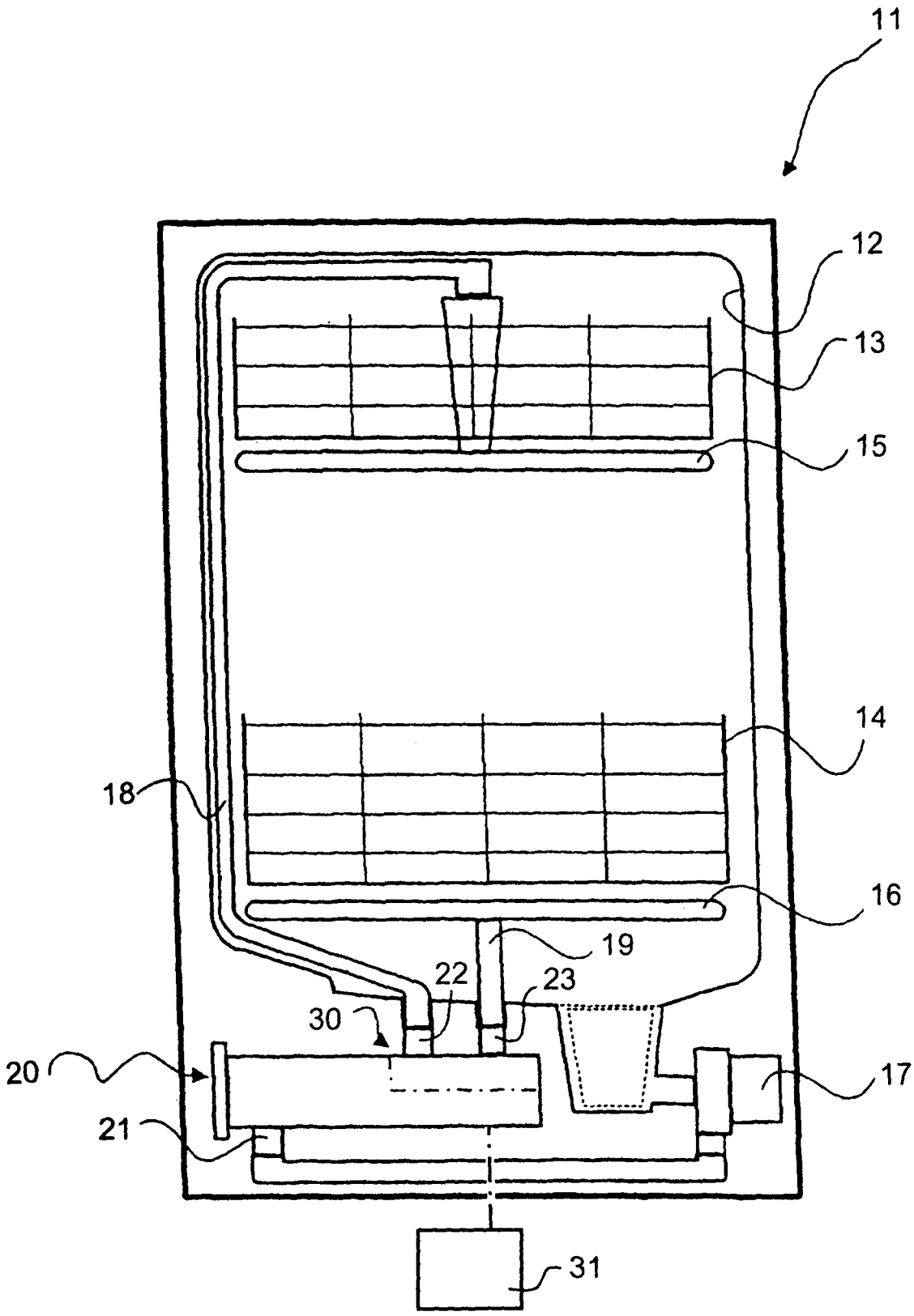
FIG. 1 is a diagrammatic, cross-sectional view of a dishwasher according to the invention.

Referring now to the figures of the drawings in detail and first, particularly to FIG. 1 thereof, there is shown a household dishwasher 11 having a dishwashing compartment 12 into which non-illustrated items that are to be cleaned, e.g., dirty dishes and cutlery, are introduced, usually into dish racks 13, 14. According to the invention, at least two spray devices, in the exemplary embodiments shown, two spray devices 15, 16, are disposed in the dishwashing compartment 12. The spray devices 15, 16 subject the items that are disposed in the dishwashing compartment 12 and are to be cleaned to the action of liquid. The liquid, usually referred to as dishwashing liquid, is delivered to the spray devices 15, 16 in liquid-supply lines 18, 19 by a circulating pump 17. It is usually the case that the liquid delivered in household dishwashers 1 is heated at least in a sub-program section of a dishwashing program, for which purpose the household dishwasher 11 according to the invention has a flow heater 20. The liquid delivered in the household dishwasher 11 is directed from the circulating pump 17 to an inflow connection 21 of the flow heater 20 and through the flow heater 20. The flow heater 20 has at least two outlet connections, namely a number of outlet connections that corresponds to the number of spray devices or simultaneously operated groups of spray devices. The flow heater 20 has two outlet connections 22, 33 in the exemplary embodiments shown. From the outlet connections 22, 23 of the flow heater 20, the liquid is supplied to the different spray devices 15, 16 respectively through the already mentioned liquid-supply lines 18, 19. The heating elements that are necessary for heating the liquid in the flow heater 20 are designated with numeral 16.

The outlet connections 22, 23 may be opened and/or closed by a changeover device 30, that is disposed on the flow heater 20 upstream of the outlet connections 22, 23, as seen in the flow direction, such that either one of the respective outlet connections 22, 23 or a number of outlet connections 22, 23 or all the outlet connections 22, 23 are opened and/or closed alternately one after the other and/or on a permanent basis. In the exemplary embodiment shown, the two outlet connections 22, 23 of the flow heater 20 may be opened and/or closed by the changeover device 30 such that either one of the outlet connections 22, 23 or both outlet connections 22, 23 are opened and/or closed alternately one after the other and/or on a permanent basis. For such a purpose, a rotary valve of the changeover device 30 is assigned to outlet openings 14, 15 of the flow heater 20. Further details concerning the operation of the rotary valve are found in U.S. Pat. No. 6,601,593 B2, which is incorporated herein in its entirety by reference. A program-control subassembly 31 which is connected to the changeover device 30 carries out the dishwashing method that is disclosed in detail below.

Figure 2:
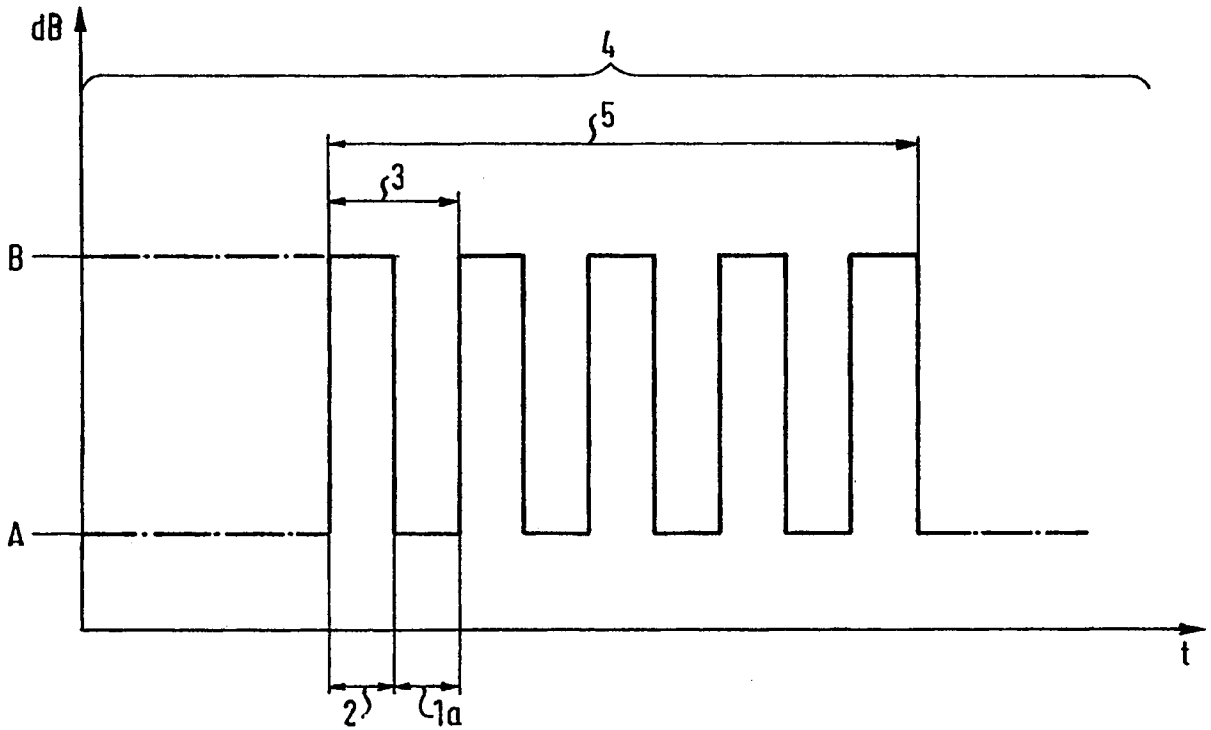
FIG. 2 is a graph showing an embodiment of the dishwashing method according to the invention with just two time sections, so that bottom-rack washing and two-rack washing is carried out.

FIG. 2 shows a diagram in which a dishwashing-program duration t is plotted on the X axis and a level of noise development dB that can be measured during the dishwashing program is plotted on the Y axis. A dishwashing-program duration 4 carried out by the program-control subassembly 31 is subdivided into a significant time period 5 which, in turn, is divided up into a multiplicity of sub-units of time 3. The lengths of the sub-units of time 3 depends on a respective dishwashing-program setting, which in turn depends on a degree of soiling and/or a temperature selection. Substantially each sub-unit of time 3 is subdivided into a first time section 2 and a second time section 1*a*, which immediately follow one after the other. Following completion of the time section 2, the time section 1*a* begins anew. The end of this time section 1*a* is followed by a time section 2. The length of the first and second time sections 2, 1*a* depends on the dishwashing-program duration.

The level of noise development which is caused by the spray devices 15, 16 changes in the respective time sections 2, 1*a*. In this case, in the time section 2, the top and bottom racks 13, 14 are subjected simultaneously to the action of dishwashing liquid, and a relatively high noise level B therefore prevails. However, in the time section 1*a*, it is only a bottom rack 14 which is subjected to the action of dishwashing liquid through the spray device 16, and the noise level thus merely reaches a level A.

According to the invention, a plurality of significant periods 5 can begin and end over the dishwashing-program duration 4, depending on the respective dishwashing program. Such a program selection thus makes it possible to associate different characteristics with the different dishwashing programs by the selection of dishwashing time periods. It is advantageous for dishwashing liquid which is fed by the circulating pump 17 to be directed, through a water diverter, such as the changeover device 30, that is controlled by the respective dishwashing program and will not be explained specifically herein, into the respectively activated pipe sections or supply lines 18, 19, in order to flow through the uppermost and lowermost spray devices 15, 16 or one spray device in accordance with the illustrated rhythm.

Figure 3:
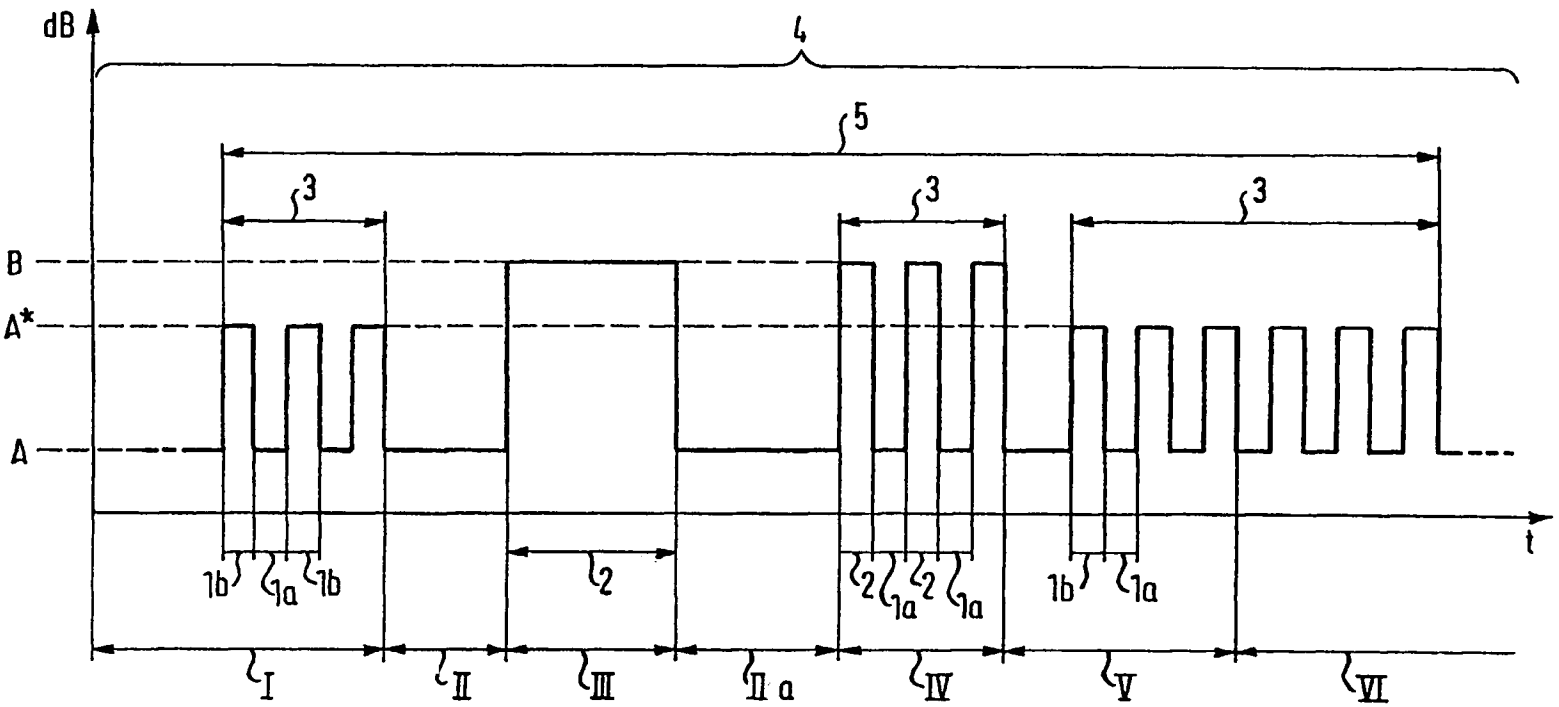
FIG. 3 is a graph showing an embodiment of the dishwashing method according to the invention throughout an entire dishwashing program with a plurality of time sections, so that bottom-rack washing, two-rack washing and top-rack washing is carried out.

The diagram according to FIG. 3 shows an entire dishwashing-program sequence with two variants, wherein respective dishwashing-program sections are indicated through the use of Roman numerals. Following a start of a dishwashing program, preliminary washing of items is carried out in a phase I and, according to the invention, the sub-unit of time 3 is divided up into time sections 1*a* and 1*b*, so that so-called alternate-rack washing is executed between the bottom rack 14 and top rack 13. In this dishwashing-program phase I, two noise levels A and A* are reached. The level A reflects a level of noise development produced by bottom-rack washing operation and the level A* reflects a noise level produced by top-rack washing operation.

The dishwashing-program phase I is followed by a dishwashing-program phase II, in which the dishwashing liquid is heated. This is followed by a dishwashing-program phase III, in which all of the spray devices 15, 16 are subjected to the action of dishwashing liquid, and the noise level B is thus reached. As an alternative to the dishwashing-program phase II, for certain countries, in particular for the United States, for example, use is made of a dishwashing-program phase IIa for heating the dishwashing liquid. This is followed by a dishwashing-program phase IV, in which there is a distinction, for cleaning purposes, between the two-rack washing operation and the single-rack washing operation, so that the time sections 2 and 1*a* follow one after the other.

The respective variants of the phases III and IV are followed by an intermediate washing phase V, in which the time sections 1*a* and 1*b* alternate. Finally, once a rinse agent has been added, a dishwashing-program phase VI begins. The items are rinsed in this phase likewise in accordance with the rhythms of the time sections 1*a* and 1*b*.

The dishwashing method according to the invention and the dishwasher according to the invention with at least two spray devices, in which, according to the invention, use of the dishwashing method according to the invention is envisaged, have thus succeeded in the task of reducing both the dishwashing-program duration of the dishwasher and the level of noise development which is caused by the impact of the water, while maintaining dishwashing performance.

We claim:

1. A method for operating a dishwasher, which comprises the following steps:

providing at least two spray devices including a lowermost spray device and an uppermost spray device;

dividing a time period of a dishwashing-program duration into a multiplicity of sub-units of time of different lengths based on a dishwashing-program setting selected by a user;

dividing each of the sub-units of time into at least first and second time sections based on the dishwashing-program setting, the length of the first and second time sections being dependent on a condition of an item to be cleaned which is indicated by the dishwashing-program setting;

passing a flow of dishwashing liquid through all of the spray devices during the first time section; and immediately following the first time section, passing a flow of dishwashing liquid through only the lowermost spray device or the uppermost spray device during the second time section.

2. The method for operating a dishwasher according to claim 1, which further comprises providing one of the sub-units of time with two time sections in which action of the lowermost spray device and the uppermost spray device alternates.

3. The method for operating a dishwasher according to claim 2, wherein all of the time sections have substantially equal length.

4. The method for operating a dishwasher according to claim 2, wherein the time sections have different lengths.

5. The method for operating a dishwasher according to claim 1, wherein all of the time sections have substantially equal length.

6. The method for operating a dishwasher according to claim 1, wherein the time sections have different lengths.

7. A dishwasher, comprising:

the at least two spray devices; and a program-control subassembly associated with said at least two spray devices for carrying out the method for operating a dishwasher according to claim 1.

8. The method of claim 1, further comprising:

immediately following the second time section of one of the sub-units of time, repeating the passing the flow of dishwashing liquid through all of the spray devices during a third time section of the one of the sub-units of time.

9. The method of claim 8, further comprising:

immediately following the third time section of the one of the sub-units of time, repeating the passing the flow of dishwashing liquid through only the lowermost spray device or the uppermost spray device during a fourth time section of the one of the sub-units of time.

10. The method of claim 1, further comprising:

providing one of the sub-units of time with a plurality of time sections in which action of the lowermost spray device and the uppermost spray device alternates between passing the flow of dishwashing liquid through all of the spray devices and passing the flow of dishwashing liquid through only the lowermost spray device or the uppermost spray device.

11. A dishwasher, comprising:

at least two spray devices including a lowermost spray device and an uppermost spray device; and a program-control subassembly associated with said at least two spray devices, the program-control subassembly being operable to control the execution of a dishwashing-program such that the dishwashing program is executed in a multiplicity of sub-units of time of different lengths, whereby the duration of the dishwashing-program duration is comprised of the combined time periods of the multiplicity of sub-units of time of different lengths based on a dishwashing-program setting selected by a user, wherein the length of the first and second time sections are dependent on a condition of an item to be cleaned which is indicated by the dishwashing-program setting; and the program-control subassembly controlling the dishwashing program during each respective subunit of time such that, during a first time section of the respective sub-unit of time, a flow of dishwashing liquid is controlled to flow through all of the spray devices, and during a second time section of the respective sub-unit of time, which immediately follows the first time section, a flow of dishwashing liquid is controlled to flow through only the lowermost spray device or the uppermost spray device.

12. A method for operating a dishwasher, the dishwasher comprising at least two spray devices including a first spray device and a second spray device, and a program-control subassembly associated with the at least two spray devices, the program-control subassembly being operable to control execution of a dishwashing-program setting selected by a user such that the dishwashing-program setting is executed over a duration of time having a plurality of sub-units of time, the method comprising:

during one of the plurality of sub-units of time, alternating between passing a flow of dishwashing liquid through all of the spray devices for a first time section of the one of the plurality of sub-units of time, and passing the flow of dishwashing liquid through only the first spray device or the second spray device for a second time section of the one of the plurality of sub-units of time, a length of the first time section and the second time section being dependent on a condition of an item to be cleaned in the dishwasher, wherein the condition is indicated by the dishwashing-program setting selected by the user.

13. The method of claim 12, further comprising:

during another of the plurality of sub-units of time, alternating between passing the flow of dishwashing liquid through only the first spray device for a third time section of the another of the plurality of sub-units of time, and passing the flow of dishwashing liquid through only the second spray device for a fourth time section of the another of the plurality of sub-units of time.

* * * * *